US007184678B2

(12) United States Patent
Ishii et al.

(10) Patent No.: US 7,184,678 B2
(45) Date of Patent: Feb. 27, 2007

(54) IMAGE FORMING APPARATUS WITH IMPROVED SEPARATABILITY OF TRANSFER MATERIAL

(75) Inventors: Hirokazu Ishii, Tokyo (JP); Satoshi Takano, Tokyo (JP); Hiroshi Saitoh, Chiba (JP); Ryoh Tanoue, Kanagawa (JP); Itaru Matsuda, Kanagawa (JP); Yuji Suzuki, Tokyo (JP); Eiji Shimojo, Tokyo (JP); Noboru Onodera, Tokyo (JP); Hidenori Nihei, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 139 days.

(21) Appl. No.: 11/013,877

(22) Filed: Dec. 17, 2004

(65) Prior Publication Data

US 2005/0180767 A1 Aug. 18, 2005

(30) Foreign Application Priority Data

Dec. 19, 2003 (JP) ..... 2003-422424

(51) Int. Cl.
*G03G 15/16* (2006.01)

(52) U.S. Cl. ..... 399/66

(58) Field of Classification Search ..... None
See application file for complete search history.

(56) References Cited

U.S. PATENT DOCUMENTS

2004/0042808 A1* 3/2004 Suzumi et al. ..... 399/66
2005/0180767 A1 8/2005 Ishii et al.

FOREIGN PATENT DOCUMENTS

| | | | |
|---|---|---|---|
| JP | 60008870 A | * | 1/1985 |
| JP | 7-168463 | | 7/1995 |
| JP | 7-234593 | | 9/1995 |
| JP | 7-271200 | | 10/1995 |
| JP | 8-146781 | | 6/1996 |
| JP | 8-146788 | | 6/1996 |
| JP | 8-160780 | | 6/1996 |
| JP | 8-190233 | | 7/1996 |
| JP | 8-227230 | | 9/1996 |

(Continued)

OTHER PUBLICATIONS

U.S. Appl. No. 11/420,402, filed May 25, 2006, Ishii.
U.S. Appl. No. 11/477,667, filed Jun. 30, 2006, Ishii.

*Primary Examiner*—Quana Grainger
(74) *Attorney, Agent, or Firm*—Oblon, Spivak, McClelland, Maier & Neustadt, P.C.

(57) ABSTRACT

An image forming apparatus in which a visible image is transferred to a transfer material includes a pre-transfer exposing unit that makes only a portion of a latent image carrier that corresponds to a leading edge of the transfer material expose, and a transfer-bias applying unit that applies a bias for transferring the visible image. The transfer-bias applying unit starts applying the bias to the transfer material, at least step-by-step, when a predetermined time is passed from a point of time at which the leading edge of the transfer material comes into a contact with the latent image carrier by controlling the pre-transfer exposing unit and a bias applying timing of the transfer-bias applying unit.

28 Claims, 9 Drawing Sheets

FOREIGN PATENT DOCUMENTS

| | | | | |
|---|---|---|---|---|
| JP | 8-227238 | | | 9/1996 |
| JP | 8-328355 | | | 12/1996 |
| JP | 9-62110 | | | 3/1997 |
| JP | 3310069 | | | 5/2002 |
| JP | 3311440 | | | 5/2002 |
| JP | 3337577 | | | 8/2002 |
| JP | 3366419 | | | 11/2002 |
| JP | 3414514 | | | 4/2003 |
| JP | 3434056 | | | 5/2003 |
| JP | 3452287 | | | 7/2003 |
| JP | 2003202762 | A | * | 7/2003 |
| JP | 3484249 | | | 10/2003 |
| JP | 3484257 | | | 10/2003 |
| JP | 3556322 | | | 5/2004 |

* cited by examiner

Post-PTL Exposure Potential and Rate of Occurrence of Separating Pawl Trail (OA Paper)

IMAGE FORMING APPARATUS WITH IMPROVED SEPARATABILITY OF TRANSFER MATERIAL

CROSS-REFERENCE TO RELATED APPLICATIONS

The present document incorporates by reference the entire contents of Japanese priority document, 2003-422424 filed in Japan on Dec. 19, 2003.

BACKGROUND OF THE INVENTION

1) Field of the Invention

The present invention relates to an image forming apparatus, and more particularly, to an image forming apparatus that includes a mechanism for separating transfer sheets.

2) Description of the Related Art

One of the image forming methods adopted in image forming apparatuses, such as the copier, printer, facsimile apparatus, or printing press involves the steps of using a developer to convert a latent image formed on a photosensitive drum, which is used as a latent image carrier, to a visible image, and transferring the visible image to a transfer sheet by means of electrostatic image transfer.

Using a toner to adhere electrostatically to the electrostatic latent image on the photosensitive drum is a well-known conversion process of latent image to visible image. The toner image obtained as a result of this method is transferred by means of electrostatic image transfer to the transfer sheet such as a recording paper. Fixing converts the toner image to a reproduction.

A transfer apparatus is used in the step involving the transfer of the toner image on the photosensitive drum to the transfer sheet. The transfer apparatus transfers the toner image to the transfer sheet by conveying the transfer sheet in such a way that the transfer sheet adheres against the toner image on the photosensitive drum, and impressing a bias.

Transfer apparatuses having a conveying belt for carrying the transfer sheet, and a pair of rollers supporting the conveying belt that impress a transfer bias on the belt that is of the opposite polarity to the toner are well known.

Once the toner image is transferred, the transfer sheet separates from the photosensitive drum and is conveyed towards a fixing apparatus. The separation of the transfer sheet from the photosensitive drum depends on the transfer sheet's flexural rigidity and the so-called nerve of the transfer sheet. In other words, the transfer sheet adhering to the photosensitive drum separates from the photosensitive drum due to a curvature separation resulting from the direction of movement of the transfer sheet at the transfer position, the direction of movement of the transfer sheet when adhering to the photosensitive drum, the fact that the direction of the transfer sheet when adhering to the photosensitive drum corresponds to the curvature of the photosensitive drum, and the transfer sheet's own form restorative force. However, when the force of the electrostatic adhesion of the transfer sheet to the photosensitive drum exceeds the transfer sheet's nerve, the transfer sheet fails to separate from the photosensitive drum.

To counter the problem, structures have been proposed wherein a separating pawl having a pointed end is provided on the surface of the photosensitive drum in a position beyond where toner image transfer takes place, or a structure is provided wherein uniform exposure is carried out prior to image transfer to reduce the background potential of the photosensitive drum while at the same time neutralizing the transfer sheet in the transfer apparatus. Such a technology is disclosed in, for example, Japanese Patent Laid-Open Publication No. 2002-268498 (Paragraph 0036).

However, in spite of reducing the adhesive force of the transfer sheet towards the photosensitive drum by reducing the potential of the photosensitive drum by means of pre-transfer exposure, the ability of the transfer sheet to separate from the photosensitive drum may be adversely affected by the setting of the transfer bias of the transfer apparatus.

The transfer bias has charge attributes that are of opposite polarity to that of the toner adhering to the photosensitive drum and may, for instance, be impressed from the underside of the conveying belt that carries the transfer sheet. However, if too much charge is injected into the conveying belt, the transfer sheet lying on the surface of the conveying belt may get charged, and its polarity is reversed. Same polarity in the transfer sheet and the photosensitive drum causes the transfer sheet and the photosensitive drum to repel each other and discourages electrostatic adhesion.

Often, the transfer bias is constantly impressed in order to maintain sufficient quantity of charge on the transfer sheet side with the aim of enhancing the efficiency of transfer. Consequently, the charge on the conveying belt side also tends to increase, resulting in the reversal of polarity of the charges on the transfer sheet side.

The transfer sheet thus repelled from the photosensitive drum may adhere to the photosensitive drum due to a residual charge on the surface of the photosensitive drum. The passage of the transfer sheet against the photosensitive drum at this stage may cause the separating pawl to scum the transfer sheet.

The scum of the transfer sheet is caused by the separating pawl attached to photosensitive drum picking up some of the toner adhering to the photosensitive drum and the toner being transferred back to the leading edge of the transfer sheet from the separating pawl.

Scum is not limited alone to the leading edge of the transfer sheet. When the entire surface of the transfer sheet adheres to the photosensitive drum and is conveyed while in contact with the separating pawl, not only does an unwanted stripe appears on the portion of the transfer sheet that is caught on the separating pawl, the unfixed image transferred to the transfer sheet is also faint.

The effect of residual charge on the surface of the photosensitive drum is explained next. Until the time neutralization is completed in the cleaning stage, the photosensitive drum retains a certain amount of charge in spite of reduction in the quantity of charge due to the effect of transfer bias. The retention of charge on the photosensitive drum causes the toner to adhere to the photosensitive drum, leading to scum (surface staining) of the photosensitive drum.

The scum of the photosensitive drum is scraped off and the photosensitive drum is neutralized in the cleaning stage so that a clean photosensitive drum is available for the next round of image formation. However, if the scum exceeds a certain amount, that is, if the charge amount between the toner and the residual charge is balanced according to the adhesion of toner, which determines the concentration of scum, the residual charge is unlikely to act on the transfer sheet and cause deterioration in its separability.

However, in the case where only charge remains and the amount of scum is less, the adhesion force due to the residual charge increases and the transfer sheet reaches the separating pawl, which causes scum of the transfer sheet.

The ease with which the transfer sheet separates is affected not only by the repulsion phenomenon described above or the residual charge, but also by the effect of the transfer bias. In other words, transfer bias is essential to effect a good charging of the belt. However, the effect of the bias varies according to the environmental conditions. That is, the charging of the belt differs according whether bias is impressed under conditions of low temperature low humidity or high temperature high humidity. Thus, impressing uniform transfer bias does not guarantee separation of the transfer sheet even if uniform neutralization is carried out by means of pre-transfer exposure.

The phenomenon of variation of charging properties according to environmental conditions is explained by taking an instance in which a moisture-absorbing paper is used as the transfer sheet.

When a double-side image formation mode is selected, a different moisture content setting is applicable when forming image on the second surface than when forming image on the first surface. The initial moisture content is set less for the second surface due to the presence of the fixer used on the first surface. Thus, the ability of the transfer sheet to separate from the photosensitive drum may vary according to the charging properties of the transfer sheet, which varies according to whether both sides are used for image formation or only a single side of different transfer sheets having varying moisture content is used or whether a composite image is formed on a single side.

The ability of the transfer sheet to separate tends to deteriorate if the transfer sheet having moisture content, etc., has inferior inherent charging properties, in particular, resistance. Further, the edge of the transfer sheet tends to curl up, making it prone to get in the way of the photosensitive drum. That is, the transfer sheet does not exactly sit flush on the belt due to the curling up of the edge.

Apart from uneven neutralization of the surface of the photosensitive drum, another factor that causes deterioration of the ability of the transfer sheet to separate from the photosensitive drum is the tendency of the separating pawl to deteriorate with time.

The separating blade tends to deform and abrade with time. Due to this, the transfer sheet that is electrostatically adhering to the photosensitive drum tends to jam at the site of the separating blade and is carried to the cleaning apparatus still stuck to the separating blade.

SUMMARY OF THE INVENTION

It is an object of the present invention to solve at least the above problems in the conventional technology.

An image forming apparatus according to one aspect of the present invention includes a structure in which an electrostatic latent image formed on a latent image carrier is developed into a visible image, and the visible image is transferred onto a transfer material being carried by a conveying member. The image forming apparatus includes a pre-transfer exposing unit that makes only a portion of the latent image carrier that corresponds to a leading edge of the transfer material expose before the visible image is transferred to the transfer material; and a transfer-bias applying unit that applies to the latent image carrier a bias necessary for transferring the visible image onto the transfer material. The transfer-bias applying unit starts applying the bias to the transfer material, at least step-by-step, when a predetermined time is passed from a point of time at which the leading edge of the transfer material comes into a contact with the latent image carrier by controlling the pre-transfer exposing unit and a bias applying timing of the transfer-bias applying unit.

The other objects, features, and advantages of the present invention are specifically set forth in or will become apparent from the following detailed description of the invention when read in conjunction with the accompanying drawings.

DETAILED DESCRIPTION

Exemplary embodiments of an image forming apparatus according to the present invention are explained below with reference to the accompanying drawings.

Figure 1:
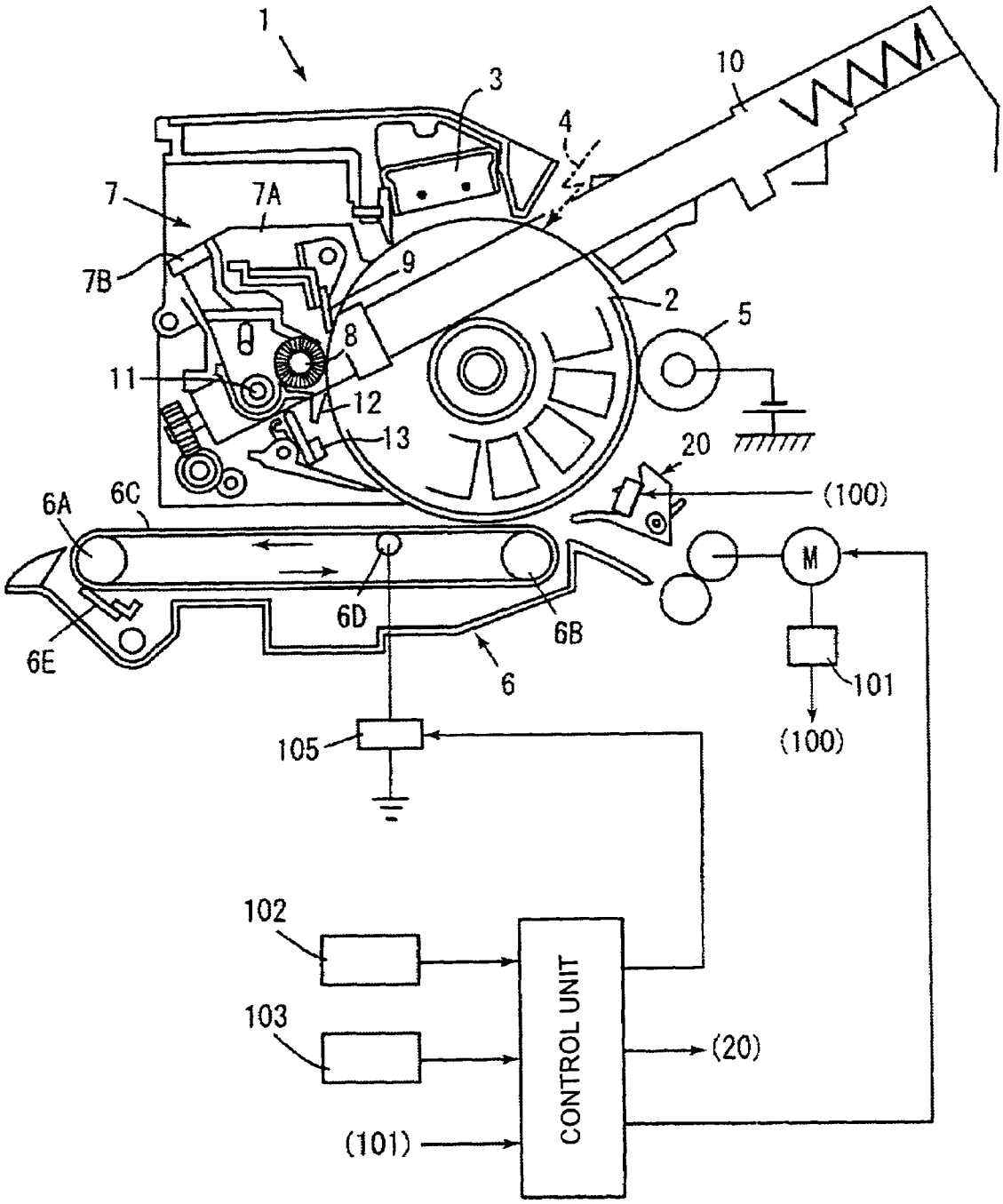
FIG. 1 is a schematic of an image forming apparatus according to an embodiment of the present invention.

FIG. 1 is a schematic of an image forming apparatus according to an embodiment of the present invention. The image forming apparatus shown in FIG. 1 is a printer that can optically read and write image information.

Instead of a printer, a copier or a facsimile apparatus or a printing press may be used in the present invention.

As shown in FIG. 1, a printer 1 includes a latent image carrier in the form of a photosensitive member (hereinafter, "photosensitive drum") 2. Arranged around the photosensitive drum 2 that turns clockwise are a charging device 3, a writing device (only an optical path is shown in FIG. 1 ) 4, a developing device 5, a transfer device 6, and a cleaning device 7. The image forming process follows this clockwise route.

The image forming process in the printer 1 is as follows. As the photosensitive drum 2 turns, the charging device uniformly charges the photosensitive drum 2. A latent image is formed on the photosensitive drum 2 by optical writing based on the image information. The developing device 5 supplies a toner to convert the latent image to a toner image by a visible image conversion process.

The transfer device 6 electrostatically transfers the toner image to a transfer sheet supplied by a not-shown transfer sheet feeder. The transfer sheet with the toner image is conveyed to a not shown fixing device, which fixes the toner image.

An amorphous silicon photosensitive member (a-Si family photosensitive member) may be used as the photosensitive drum 2. The amorphous silicon photosensitive member is obtained by subjecting a conductive substrate holder to a heat of 50 degree Celsius (° C.) to 400° C. and coating the photosensitive member with an amorphous silicon (a-Si) layer by means of any of the coating methods such as vacuum evaporation, sputtering, ion plating, thermal chemical vapor deposition (thermal CVD), optical CVD, plasma CVD, etc.

Amongst the methods mentioned above, the plasma CVD method is the most prevalent method for forming the a-Si coating on the substrate holder. The plasma CVD method involves breaking up reactant gases by high frequency wave or microwave glow neutralization and forming an a-Si film on the substrate holder.

The transfer device 6 used in the present embodiment includes a belt 6C that supports and carries transfer sheets such as a recording sheet. One end of the belt 6C is in contact with the photosensitive drum 2.

The surface of the belt 6C is composed of a fluorocarbon material having a low coefficient of friction and an inherent surface friction (JISK6911) of $1\times10^{10}$ ohms to $1\times10^{12}$ ohms. The base layer supporting the surface layer is composed of a gum material such as chloroprene gum, EPDM gum, epichlorohydrin gum, etc. or a blend thereof. However, material with controlled resistance can be formed by blending conductive materials such as carbon or metal oxide, and used on the gum surface to set the surface resistance of the gum surface to an intermediate resistance of the range of $1\times10^{7}$ ohms to $1\times10^{9}$ ohms. It is also possible to select a resistance of $10^{13}$ or greater and $10^{6}$ or less in the present invention.

In the portion where the belt 6C is in contact with the photosensitive drum 2, the transfer sheet moves caught between the former and the letter. This portion forms a transfer nip and is the portion where the toner image on the photosensitive drum 2 is electrostatically transferred to the transfer sheet.

The structure that facilitates transfer of the toner image from the photosensitive drum 2 to the transfer sheet in the present invention is a bias roller 6D. The bias roller 6D is located on the underside of the belt 6C in a position beyond the transfer nip.

The bias roller 6C is located ahead of the transfer nip in the direction of movement of the belt 6C so that it can impart a potential on the belt 6C enough for the toner to electrostatically adhere to the transfer sheet by the time the transfer sheet reaches the transfer nip. Consequently, upon reaching the transfer nip, the transfer sheet is charged with a polarity opposite to that of the toner due to charge polarization between the transfer sheet and the belt 6C. As a result, the toner on the photosensitive drum 2 is electrostatically transferred to the transfer sheet.

A belt cleaning device 6E cleans the toner adhering to the surface of the belt 6C that has gone past the transfer nip and prevents scum of the transfer sheet.

The cleaning device 7 of the photosensitive drum 2 includes a cleaning brush 8 and a cleaning blade 9 that come in contact with the photosensitive drum 2. The cleaning brush is housed in a unit 7A that opens into the photosensitive drum 2 and is located upstream of the direction of rotation of the photosensitive drum 2. The cleaning blade 9, composed of urethane, is located downstream of the direction of rotation of the photosensitive drum. The unit 7A of the cleaning device 7 further has a collection coil 11, a seal 12, a pressure remover 7B. The collection coil 11 directs the toner collected from the photosensitive drum 2 as recycled toner to a pipe 10 for reuse. The seal 12 seals the upstream entry point of the unit 7A located upstream of the direction of rotation of the photosensitive drum 2. A concentration sensor 13 shown in FIG. 1 detects the concentration of the developer.

Once the toner image is transferred from the photosensitive drum 20 the transfer sheet, the leading edge of the transfer sheet is caught by a separating pawl 15 located close to the photosensitive drum 2 beyond the transfer nip, and carried to a not shown fixing device after flipping the direction of conveyance at the position of the belt 6A.

In the present embodiment, a PTL 20 is provided in the path of the rotation of the photosensitive drum 2 on the way to the transfer nip.

The pre-transfer lamp 20 uniformly reduces the surface potential, and particularly that of the non-image portion, of the photosensitive drum 2, thus preventing the toner from scattering from the image portion and adhering to the non-image portion of the photosensitive drum 2.

The structure of the main feature of the present embodiment is explained next.

The main feature of the present embodiment is preventing the adherence of the transfer sheet to the photosensitive drum 2 while facilitating the adherence of the transfer sheet to the belt 6A. This is achieved by reducing the pre-transfer charge potential of the photosensitive drum 2 by controlling the pre-transfer exposure and the timing of transfer bias impression. The structure of this feature is explained next.

In the present embodiment, the transfer sheet is made to separate easily from the photosensitive drum 2 while at the same time causing a charge polarization between the transfer sheet and the belt C thereby facilitating the adherence of the transfer sheet to the belt 6C by controlling the On and Off timing of the pre-transfer exposure as well as the timing of the transfer bias impression.

A control unit 100 shown in FIG. 1 executes an image forming sequence program.

The control unit 100 is connected, via a not shown I/O interface, to a start sensor 101, an operation panel 102, an environmental condition detecting sensor 103, and a type sensor 104. The start sensor 101 detects the starting status of a resist mode M located at a position from where it can dispatch the transfer sheet towards the transfer nip. The operation panel allows selection of the image formation mode or the size of the transfer sheet. The environmental condition detecting sensor 103 detects the humidity and temperature conditions in the printer 1. The type sensor 104 detects the On signal of a feeding roller provided at the feeding cassette exit point of the not shown paper feeder and detects the type of the transfer sheet being conveyed.

The type sensor 104 may be replaced with a feeding cassette selection switch, etc. However, if the selection switch is to be used, information pertaining to the type of the transfer sheet stacked in the feeder cassette, namely ordinary paper, OA paper, film, or OHP, etc., in a correlated form needs to be loaded beforehand as feeder cassette information.

A transfer bias drive circuit 105, a resist motor M, and a driving unit (for simplicity's sake, the connection is shown to the pre-transfer lamp 20 in FIG. 1) of the pre-transfer lamp 20 are connected at the output end of the control unit 100.

The action of the control unit 100 is explained below. The control unit acts by controlling the On/Off timing of the pre-transfer lamp 20 and the transfer bias timing.

Figure 2:
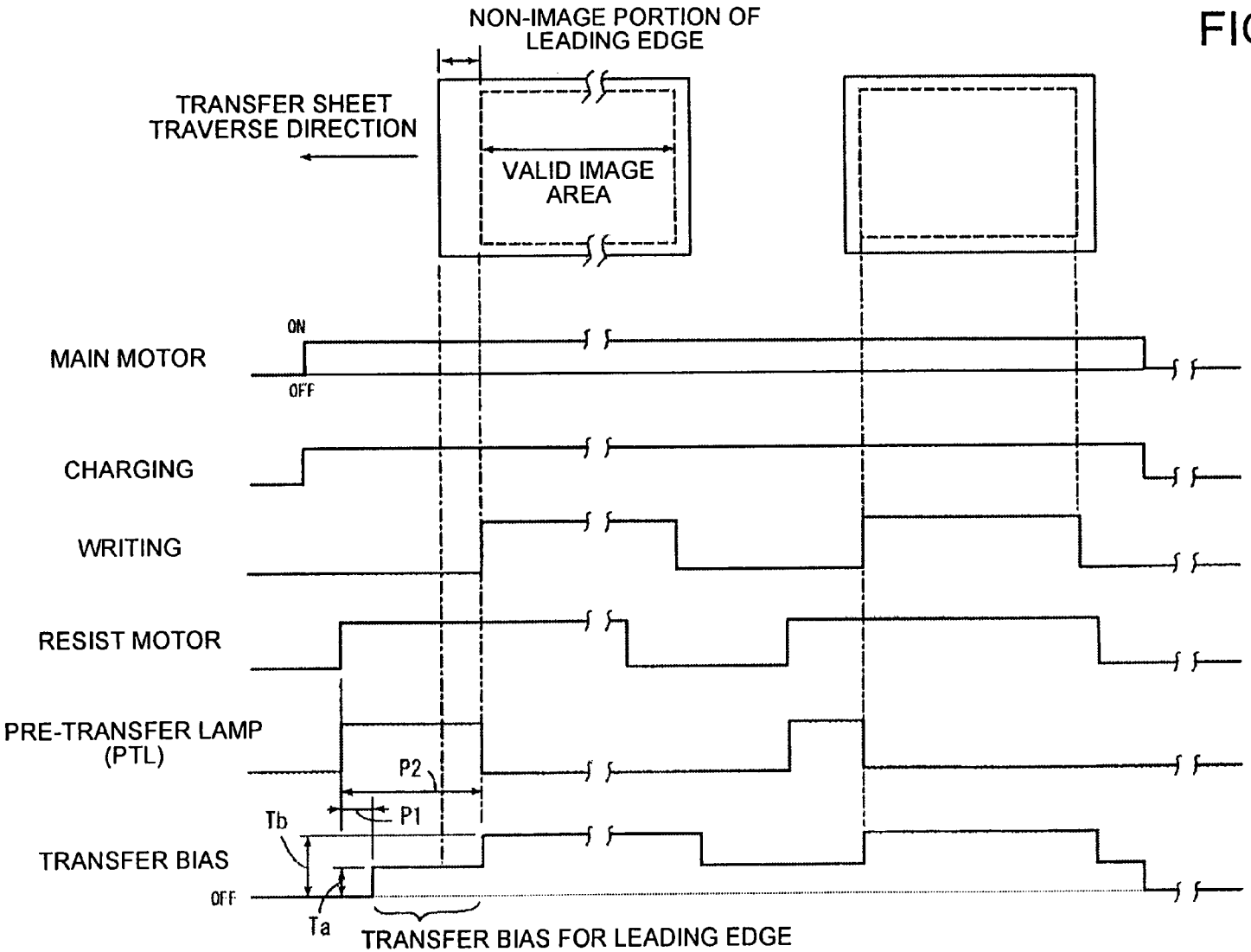
FIG. 2 is a timing chart of an action in a control unit in the image forming apparatus shown in FIG. 1.

It is assumed that the scattering of the toner from the image portion to the non-image portion is prevented by switching the pre-transfer lamp 20 on or off in the image portion of the photosensitive drum 2 based on the timing chart shown in FIG. 2. The starting of the resist motor M is taken as a trigger signal for switching on the pre-transfer lamp 20. Once the boundary of the non-image portion on the photosensitive drum 2, which is demarcated from the transfer sheet size and traverse speed selected on the operation panel 102, is reached, the pre-transfer lamp 20 is switched off.

In the present embodiment, if the traverse speed of the transfer sheet is 362 millimeter/second (mm/sec), the pre-transfer lamp 20 is switched on at the instant when the resist motor M starts, and the photosensitive drum 2 is uniformly exposed. Upon elapse of 108.4 ms from the time it is switched on, the pre-transfer lamp 20 is switched off.

If the traverse speed is 270 mm/sec, the pre-transfer lamp 20 is switched on at the instant when the resist motor M starts and is switched off upon elapse of 139.9 ms from the time it is switched on. The trigger signal need not necessarily be limited to resist motor and may for instance be a write signal of a write light source in the writing device. Moreover, the amount of exposure from the pre-transfer lamp 20 need not necessarily be a constant amount, and may be varied according to the image formation mode, namely, single-side or double-side image formation, or environmental conditions such as temperature and humidity.

The pre-transfer lamp 20 in the present embodiment is switched on at the instant when the resist motor M starts, as shown in the timing chart shown in FIG. 2, and its exposure duration is set such that the surface potential of the photosensitive drum 2 does not exceed 250 volts (V). This condition, apart from preventing the scattering of the toner from the image portion to the non-image portion, also deters the leading edge of the transfer sheet from adhering to the photosensitive drum 2.

If the leading edge of the transfer sheet adheres to the photosensitive drum 2, it may interfere with the separating pawl causing damage. To counter this, in the present embodiment, a charge density of $2.0\times10^{-8}$ C/cm$^2$, which is a lower charge density than that resulting from a standard transfer bias, is set, that is a transfer output charge density is set, at the bias impression end corresponding to the non-image portion of the leading edge of the transfer sheet that is carried by the belt 6C in the period labeled as end transfer bias in the timing chart shown in FIG. 2. In other words, in the timing chart shown in FIG. 2, when the leading edge of the transfer sheet reaches the nip, a non-image portion transfer bias (Ta) and an image portion transfer bias (Tb) impressed at the leading edge of the transfer sheet are grated, the non-image portion transfer bias Ta being lower than the image portion transfer bias Tb. The setting of graded transfer bias is disclosed in an earlier application by the same applicants as those the present invention in Japanese Patent Laid-Open Publication No. 2002-323817. While one method of setting graded transfer bias is by setting a lower transfer bias than the standard transfer bias that is impressed on the on-image portion of the leading edge of the transfer sheet from the Off status of bias impression followed by setting of the standard transfer bias, it is by no means the only method. Other methods, such as setting a standard transfer bias from an Off status of bias impression between transfer sheets, may be adopted.

Thus, by setting the transfer output charge density, the non-image portion of the leading edge of the transfer belt, which comes before the image portion that receives the standard transfer bias, is not charged. Since the belt 6C and the transfer sheet are of the same polarity, there is no repulsion between the two. The charge polarization between the belt 6C and the transfer sheet further promotes the electrostatic adhesion of the transfer sheet to the belt 6C.

The pre-transfer lamp 20 used in the present embodiment may be lamp unit that uses a light-emitting diode (LED) array or a unit that exposes by emitting laser beam writing light that is used in the writing device on a specific spot.

In the method that uses the laser beam, the writing light uses a method similar to writing using a polygonal mirror provided in a writing optical system. Therefore, when forming images having several colors, there is an advantage in that the surface potential of the photosensitive drum is reduced within a stage in the writing sequence by a writing process that does not involve image writing process.

The transfer bias is impressed at the instant when the leading edge of the transfer sheet comes in contact with the photosensitive drum 2, that is, at the instant when the leading edge of the transfer sheet reaches the transfer nip. To control the transfer bias impression timing, a period is set from the time the resist motor M starts and the end transfer bias meant for the non-image portion is impressed after a delay of P1, to the time when the regular transfer bias is impressed on the image portion after a delay of P2, which is the estimated time required for the image portion to reach the transfer nip.

In other words, the time required for the transfer sheet to traverse from the time the resist roller starts rolling to the time when the leading edge of the transfer sheet reaches the transfer nip is delayed beyond the start time of normal bias impression, that is, the timing that marks the start of the resist roller starting the conveyance of the transfer sheet.

Thus, the bias is impressed when the transfer sheet advances to a position by traversing a distance equivalent of the delay time. That is, the bias is impressed when the traverse distance has increased.

As a result, in the present embodiment, when the leading edge of the transfer sheet reaching the transfer nip, the graded bias meant for the non-image portion corresponding to the leading edge and the subsequent image portion is impressed. Consequently, the duration, for which charging of the belt 6C occurs, becomes shorter as compared to when a normal bias is impressed before the leading edge reaches the transfer nip. Thus, the belt 6C has less quantity of charge when a graded bias is impressed as compared to when a normal bias is impressed.

Delaying the bias impression timing so as to increase the traverse distance of the transfer sheet produces the following effect.

If the traverse speed of the transfer sheet is 362 mm/sec and the normal bias impression start timing is set at a delay of 127 ms from the time the resist motor M is switched on (hereinafter, the delay of 127 ms is referred to as "standard"), in the present invention, the normal bias is impressed after the lapse of the time-equivalent of the traverse distance-equivalent of the standard to which 20 millimeter (mm) is added. That is, the bias is impressed after a delay of 183 ms from the time the resist motor M is switched on.

The time at which the transfer bias is impressed in the present embodiment is not fixed and can be varied according to the findings of the environmental condition detecting sensor 103 connected to the control unit 100. The bias impression timing can be varied, in conjunction with the pre-transfer lamp 20 and in accordance with the change in the conditions that affect the charging properties, particularly so as to achieve the desired object of preventing the transfer sheet from adhering to the photosensitive drum 2 and to promote the adhesion of the transfer sheet to the belt 6C.

The inventors of the present invention performed a comparative experiment by controlling the exposure timing by the pre-transfer lamp 20 as well as the timing when the bias is impressed by the bias roller 6C, and controlling only the exposure timing by the pre-transfer lamp 20. The result obtained because of the structure of the present embodiment being as described above is shown in FIG. 13. Further, FIG. 13 shows the rate of occurrence of the separating pawl trail due to the variation of the transfer bias impression timing according to the surface potential of the photosensitive drum 2 following the exposure by the pre-transfer lamp 20.

The line that is labeled "Bias impression timing: Standard" shown in FIG. 13 represents the usual bias impression timing, and the line that is labeled 'Bias impression timing: Standard+20' represents the bias impression timing according to the present embodiment.

Figure 13:
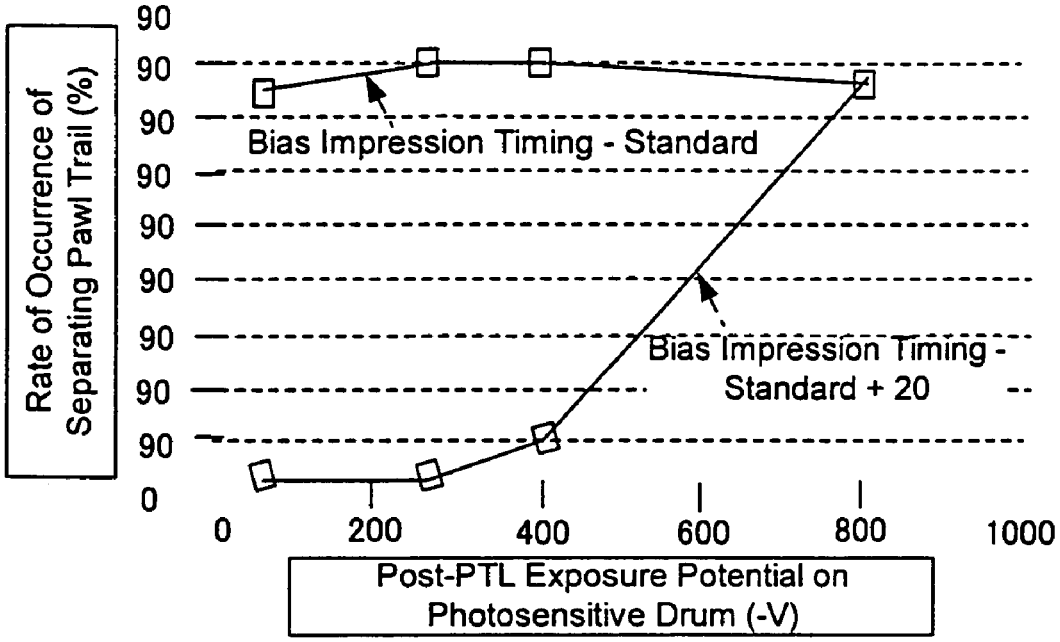
FIG. 13 is a graph of a rate of occurrence of a separating pawl trail due to variation of a transfer bias impression timing according to a surface potential of the photosensitive drum after exposure by a pre-transfer lamp (PTL).

As shown in FIG. 13, the rate of occurrence of the separating pawl trail is 10% or less when the bias is impressed is delayed and when the post-exposure surface potential of the photosensitive drum 2 is 400 V or less. However, the rate of occurrence of the separating pawl trail is 80% when the bias is impressed at the usual timing with no delay. Thus, the rate of occurrence of the separating pawl trail can be effectively reduced by delaying the bias impression timing.

Only lowering the surface potential of the photosensitive drum 2 by means of the pre-transfer lamp 20 does not promote the reduction of the charge amount on the belt 6C and completely prevent the effect of the charge present on the belt 6C on the transfer sheet. That is, by only lowering the surface potential, the transfer sheet and the belt 6C tend to repel each other and the transfer sheet tends to adhere more easily to the photosensitive drum 2.

The tendency of the leading edge of the transfer sheet to adhere to the photosensitive drum 2 can be in particular prevented by reducing the surface potential of the photosensitive drum in the vicinity of the leading edge by means of the pre-transfer lamp 20. Further, charge polarization is caused between the belt 6C and the transfer sheet when the end transfer current is reduced. The charge polarization establishes an influence opposite to the mutual repulsion between the belt 6C and the transfer sheet and facilitates the transfer sheet to adhere to the belt 6C.

Table 1 and Table 2 show the result of the comparative experiment, which involves controlling the timing at which the transfer bias is impressed by doing a pre-transfer exposure and by not doing a pre-transfer exposure. This experiment was conducted by the inventors of the present invention using transfer sheets of different types that have a tendency to interfere with the separating pawl.

Table 1 shows the result for a traverse speed of 270 m/sec, and Table 2 shows the result for a traverse speed of 362 m/sec. In both Table 1 and Table 2, 'PTL: ON' indicates that the pre-transfer exposure was carried out along with the control of the transfer bias timing, and 'PTL: OFF' indicates that the pre-transfer exposure was not carried out and only the control of the transfer bias timing was carried out.

TABLE 1

| | | PTL: ON | | | PTL: OFF | | |
|---|---|---|---|---|---|---|---|
| Paper type | Size | Number of sheets for which pawl separation occurred | Number of sheets used | Rate of occurrence of pawl separation | Number of sheets for which pawl separation occurred | Number of sheets used | Rate of occurrence of pawl separation |
| OA paper (Old lot) | A4Y | 0 | 20900 | 0% | 3216 | 5948 | 54.1% |
| OA paper (New lot) | A4Y | 0 | 216530 | 0% | 5447 | 28598 | 19.0% |
| EW-100 | A4Y | 0 | 1500 | 0% | 217 | 1196 | 18.1% |
| EN-100 | A4Y | 0 | 2486 | 0% | 394 | 1891 | 20.8% |
| α-eco paper - Type D | A4Y | 0 | 1964 | 0% | 38 | 1700 | 2.2% |
| Paper source S | A4Y | 0 | 1500 | 0% | 404 | 1497 | 27.0% |
| 45K paper | A4Y | 0 | 2926 | 0% | 24 | 1100 | 2.2% |
| My recycle 100 | A4Y | 0 | 3491 | 0% | 23 | 200 | 11.5% |
| T6200 | A3Y | 0 | 16 | 0% | 2 | 24 | 8.3% |
| Paper source S | B5Y | 0 | 1387 | 0% | 44 | 600 | 7.3% |
| Total | | 0 | 252700 | 0% | 9809 | 42754 | 22.9% |

TABLE 2

| Paper type | Size | PTL: ON Number of sheets for which pawl separation occurred | PTL: ON Number of sheets used | PTL: ON Rate of occurrence of pawl separation | PTL: OFF Number of sheets for which pawl separation occurred | PTL: OFF Number of sheets used | PTL: OFF Rate of occurrence of pawl separation |
|---|---|---|---|---|---|---|---|
| OA paper (Old lot) | A4Y | 0 | 1500 | 0% | 94 | 1200 | 7.8% |
| OA paper (New lot) | A4Y | 0 | 124022 | 0% | 502 | 13500 | 3.7% |
| EW-100 | A4Y | 0 | 1496 | 0% | 132 | 1500 | 8.8% |
| EN-100 | A4Y | 0 | 992 | 0% | 129 | 1391 | 9.3% |
| α-eco paper - Type D | A4Y | 0 | 1465 | 0% | 283 | 900 | 31.4% |
| Paper source S | A4Y | 0 | 1246 | 0% | 455 | 1244 | 36.6% |
| 45K paper | A4Y | 0 | 1013 | 0% | 289 | 1500 | 19.3% |
| OA paper (New lot) | B5Y | 0 | 1100 | 0% | 146 | 880 | 16.6% |
| Paper source S | B5Y | 0 | 1492 | 0% | 385 | 1500 | 25.7% |
| EN-100 | B5Y | 0 | 1800 | 0% | 33 | 391 | 8.4% |
| Total | | 0 | 136126 | 0% | 2448 | 24006 | 10.2% |

The results shown in Table 1 and Table 2 have been obtained under the environmental conditions of high temperature and high humidity as well as low temperature and low humidity, although the moisture percentage of the transfer sheets was not adjusted.

In the present embodiment, the bias impression timing can be changed according to the detection signal by the environmental condition detection sensor 103 of the control unit 100. Table 3 shows the result obtained when the bias impression timing is changed.

Table 3 indicates the result of comparison obtained by doing a pre-transfer exposure as well as not doing a pre-transfer exposure on the transfer sheets with a good measure of moisture percentage in them due to being placed under the conditions of high humidity (20° C. and a relative humidity of 90%) for 8 hours, with the same bias impression timing.

TABLE 3

| | 270 mm/sec Number of sheets for which pawl separation occurred/Number of sheets used/ | 270 mm/sec Rate of occurrence of pawl separation | 362 mm/sec Number of sheets for which pawl separation occurred/Number of sheets used | 362 mm/sec Rate of occurrence of pawl separation |
|---|---|---|---|---|
| PTL: OFF | 1018/7003 | 14.50% | 150/3850 | 3.90% |
| PTL: ON | 0/4779 | 0% | 0/4812 | 0% |

From Table 3 it can be discerned that doing a pre-transfer exposure along with the control of the transfer bias timing does not allow the separating pawl to separate the transfer sheet. That is, since the transfer sheet is adhering to the photosensitive drum 2 and is continuing to move with it, the transfer sheet does not reach the separating pawl and hence is not separated.

Figure 3:
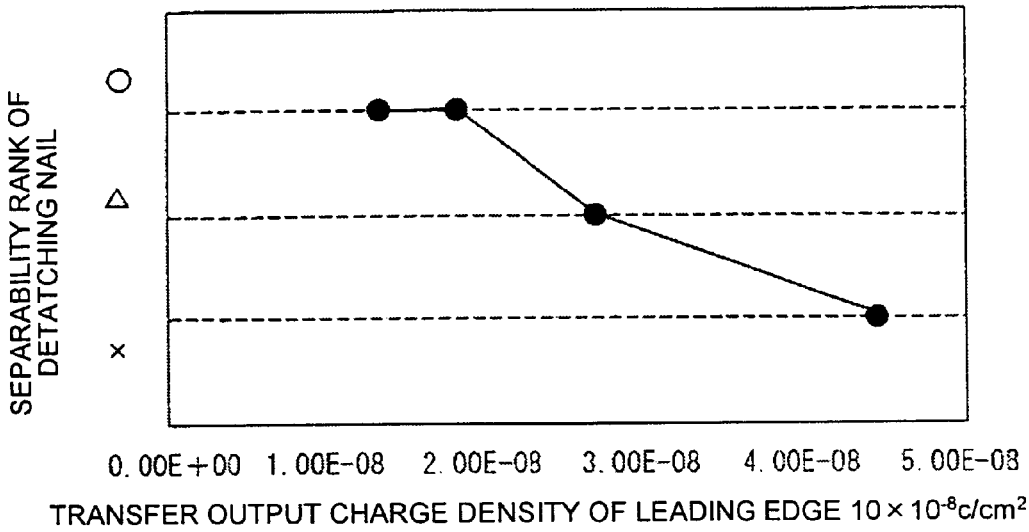
FIG. 3 is a line graph for explaining a relation between a transfer output charge density of a leading edge and a separability of transfer sheets that is obtained from an experiment with the image forming apparatus shown in FIG. 1.

By regulating the transfer output charge density (the leading edge transfer output charge density) of the leading edge to $2.0\times10^{-8}$ C/cm$_2$ or less the charging of the belt 6C is prevented, leading to polarization between the transfer sheet and the belt 6C. Because of this, there is a reduced tendency for the transfer sheet to interfere with the separating pawl as the transfer sheet adheres to the photosensitive drum 2. FIG. 3 is a line plot of the result obtained from the experiment conducted in this regard.

FIG. 3 shows the pawl separation ranking (that is, the probability of interference with the separating pawl) according to the edge transfer charge densities of the transfer sheet selected by controlling the pre-transfer exposure along with the control of the transfer bias timing (Standard+20 mm).

In FIG. 3, "Good" represents non-occurrence (0%) of pawl separation, "Fair" represents 50% to 70% pawl separation occurrence, and "POOR" represents 70% or greater pawl separation occurrence. OA paper was used for the experiment.

The leading edge transfer output charge density can be applied to the mode of conveyance of the transfer sheet. That is, if the transfer sheet is a recording paper, the leading edge transfer output charge density can be applied to a single paper conveyance mode or a continuous paper conveyance mode. The leading edge transfer output charge density is equivalent to the charge amount resulting from the bias between transfer sheets or paper, being fed.

The bias between the transfer sheets is impressed to prevent adhesion of the opposite-charged toner to the belt 6C. Correspondingly, the regular transfer bias that is impressed to facilitate transfer is affected by the conveyance rate of the transfer sheet and is set high in proportion to the traverse speed of the conveying unit so as to attain the charge amount required for realizing the electrostatic adhesion of the transfer sheet and the transfer of the toner image.

In the present embodiment, for a transfer sheet traverse speed of 362 mm/sec, the bias between the transfer sheets (between papers) is set as 15 microamperes (μA), and the transfer bias is set as 65 μA. Further, for a transfer sheet traverse speed of 270 mm/sec, the bias between the transfer sheets (between papers) is set as 10 μA, and the transfer bias is set as 50 μA.

Figure 4:
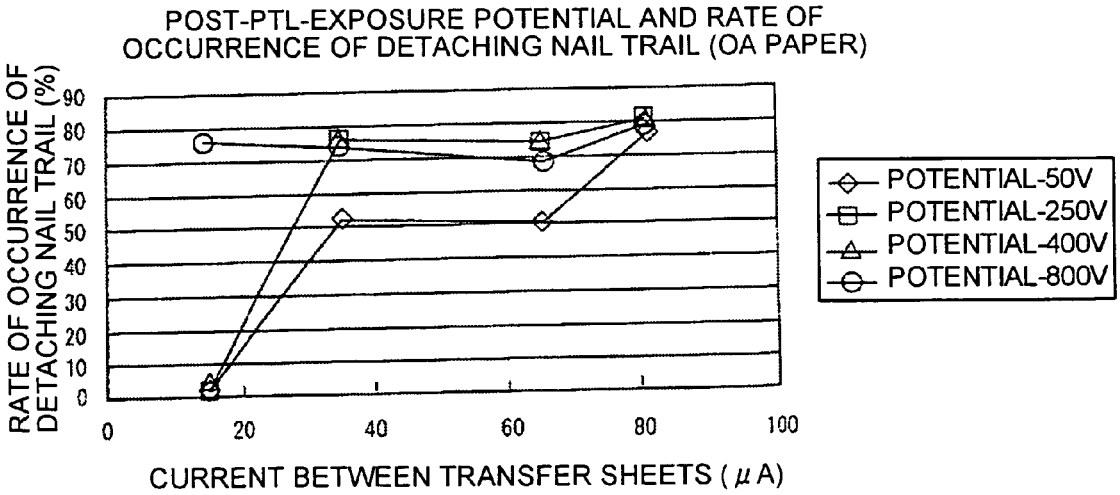
FIG. 4 is a line graph for explaining a relation between a bias current that corresponds to the leading edge of the transfer sheet and the separability of the transfer sheets that is obtained from an experiment with the image forming apparatus shown in FIG. 1.
Figure 5:
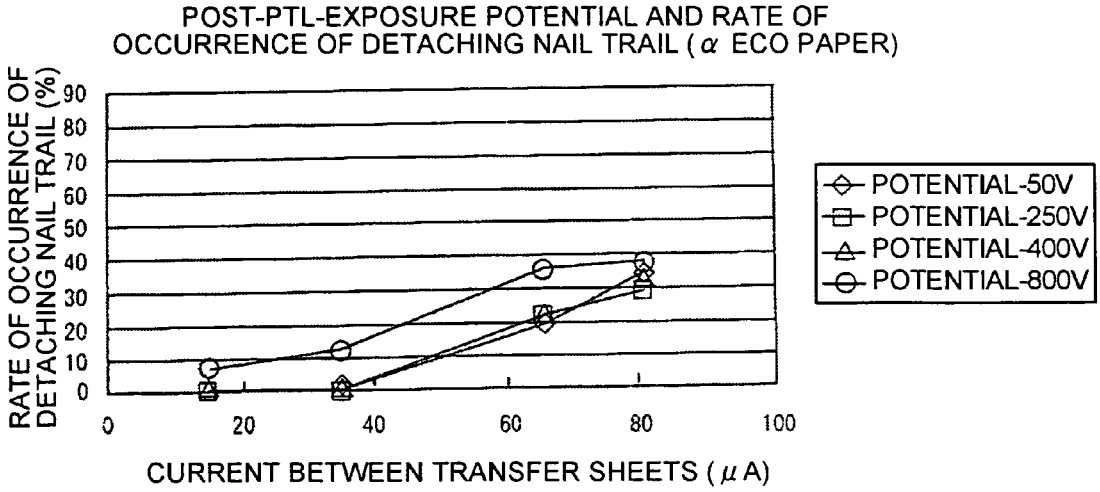
FIG. 5 is a line graph for explaining a relation between the bias current and the separability of the transfer sheets with different values of the bias current from values of the bias current shown in FIG. 4.

FIG. 4 is a line plot showing the rate of occurrence of pawl separation when OA paper is used and when bias is impressed between transfer sheets, and pre-transfer exposure is carried out along with transfer bias timing control (Standard+20). FIG. 5 is a line plot showing the rate of occurrence of pawl separation when α-eco paper is used, and when bias is impressed between transfer sheets, and pre-transfer exposure is carried out along with transfer bias timing control (Standard+20).

The bias between the transfer sheets varies according to the material of the transfer sheet. In the case of OA paper shown in FIG. 4, the bias between the transfer sheets (between the papers) is 15 μA and in the case of α-eco paper shown in FIG. 5, the bias is set as 35 μA. In both cases the conveyance speed is 362 mm/sec.

It is possible to prevent pawl separation from occurring when using OA paper if the bias between the transfer sheets is 15 μA. Similarly, when using α-eco paper, occurrence of pawl separation can be prevented even if the bias between the transfer sheets is 35 μA.

The result shown in FIG. 3 is obtained by controlling the current (hereinafter, "$I_{out}$") supplied to the photosensitive drum 2. In the present embodiment, the rate of pawl separation can be made 0% by setting an $I_{out}$ of 15 μA when the transfer sheet traverse speed is 362 mm/sec and an effective bias roller length is 310 mm.

The relation between the leading edge transfer output charge density and current supplied to the photosensitive drum in this instance is determined by expression given below.

$$\text{Leading edge transfer output charge density} = I_{out}/(v \cdot L) \quad (1)$$

where v is the traverse speed of the belt 6C, and L is the length of the bias roller 6D.

FIG. 3 shows the result obtained according to expression (1) if the length of the bias roller is taken as 310 mm.

According to the present embodiment, the charge density at the leading edge of the transfer sheet can be set to a specific condition by setting the transfer bias timing and the bias value. Consequently, no special structure is required to prevent the transfer sheet from adhering to the latent image carrier. This can be achieved merely by having a transfer bias control mechanism.

Another control function of the control unit 100 will be explained next.

Apart from pre-transfer exposure, the control unit 100 also plays a role in preventing degradation of the photosensitive layer of the photosensitive drum 2 caused by electrostatic fatigue due to prolonged exposure to light. It is preferable to reduce as much as possible the exposure of the photosensitive layer of the photosensitive drum to light so as to avoid electrostatic fatigue. The control unit 100 according to the present embodiment allows setting image formation mode, transfer sheet type, and environmental conditions as conditions that discourage the transfer sheet from adhering to the photosensitive drum 2.

Selection of the image formation mode, namely double-side image formation mode and single-side composite image formation mode, has a bearing on the moisture percentage of the transfer sheet. If, for instance, double-side mode is selected, the initial moisture percentage is set less for the second surface due to the presence of the fixer used on the first surface. The ability of the transfer sheet to separate from the photosensitive drum 2 may vary according to the charging properties of the transfer sheet, which in turn is affected by the moisture percentage. Consequently, it is necessary to control the pre-transfer exposure of the photosensitive drum 2 according to the image formation mode.

Table 4 shows the result obtained by the inventors of the present invention when they compared the rate of occurrence of pawl separation at a traverse speed of 270 mm/sec under conditions of combined pre-transfer exposure and transfer bias timing control (PTL: On), only transfer bias timing control with no pre-transfer exposure (PTL: Off), and no pre-transfer exposure (PTL: Off) on the second surface of the transfer sheet.

TABLE 4

| Double-side mode | Number of sheets for which pawl separation occurred | Number of sheets used | Rate of occurrence of pawl separation |
|---|---|---|---|
| First surface (PTL: OFF) | 9809 | 42754 | 22.9% |
| First surface (PTL: ON) | 0 | 252700 | 0% |
| Second surface (PTL: OFF) | 1 | 295454 | 0.000003% |

As shown in Table 4, the low moisture percentage setting for the second surface of the transfer sheet in the double-side image formation mode causes the resistance of the transfer sheet to rise. The increase resistance tends to give rise to charge polarization between the transfer sheet and the belt 6C. This enhances the ability of the transfer sheet to separate from the photosensitive drum 2. Consequently, when the double-side image formation mode is selected, pre-transfer exposure can normally be dispensed with when carrying out image formation on the second surface. However, there is a possibility, though very slim (0.000003%) of occurrence of pawl separation. Thus, even though it is preferable to not to subject the photosensitive drum 2 to exposure so as to prevent the occurrence of electrostatic fatigue of the photosensitive layer, the control unit 100 exerts control so that pre-transfer exposure takes place if the moisture percentage of the second surface is anything but that in which the pre-transfer exposure can be dispensed with.

The control unit 100 uses the moisture content environmental condition as a parameter for exerting this control. In other words, when the environmental condition detecting sensor 103 connected to the control unit 100 senses that the moisture content is above a predetermined threshold value, the control unit 100 causes the pre-transfer exposure to take place. If the moisture content is below the threshold value, the control unit 100 exerts control so that no pre-transfer exposure takes place.

In addition to the moisture content, thickness of the transfer sheet is another factor that has a bearing on the ability of the transfer sheet to separate from the photosensitive drum 2.

Flexural rigidity, that is, the form restorative force, of the material of the transfer sheet, plays a role in the ease with which the transfer sheet separates from the photosensitive drum 2.

Table 5 shows the relation between the thickness of transfer sheet and its separability from the experiment by the inventors of the present invention.

TABLE 5

| | Rate of occurrence of pawl separation |
|---|---|
| OA paper (Ordinary) | 22.9% |
| Superior quality 90 Kg (Medium thickness) | 0% |
| Superior quality 180 Kg (Thick) | 0% |

As can be discerned from Table 5, the thicker the transfer sheet is, the better the separability becomes. The control unit 100 in the present embodiment is designed such that it controls the pre-transfer exposure according to the selected thickness of the transfer sheet. The control unit 100 shortens the pre-transfer exposure duration as the thickness increases, and sets the pre-transfer exposure to Off for the maximum thickness.

Transfer sheets of varying thicknesses can be separately stacked in different feeding cassettes and information pertaining to the thickness of the transfer sheets in the feeding cassettes provided in the paper feeder is loaded beforehand in the control unit 100. The control unit 100 then determines the thickness of the transfer sheet based on the selected feeder cassette and accordingly controls the pre-transfer exposure duration.

Similarly, information pertaining to the quality of the transfer sheets can also be loaded, since the quality has a bearing on the moisture absorbing property of the transfer sheet. For instance, transfer sheets of different qualities can be stacked in different feeder cassettes and information pertaining to the quality of the transfer sheets in the feeding cassettes provided in the paper feeder is loaded beforehand in the control unit 100. The control unit 100 then determines the quality of the transfer sheet based on the selected feeder cassette and accordingly controls the pre-transfer exposure duration.

Thus, the control unit 100 sets the pre-transfer exposure duration according to the conditions affecting the separability, namely, the nerve or the moisture-absorbing property, of the transfer sheet, and prevents degradation of the photosensitive layer by preventing subjecting the photosensitive drum 2 to unnecessary exposure. Similarly, the pre-transfer exposure and the transfer bias impression timing can be controlled in the case of the single-side composite image formation mode as well, since the conditions imitate double-side image formation mode when a composite image is formed.

Figure 6:
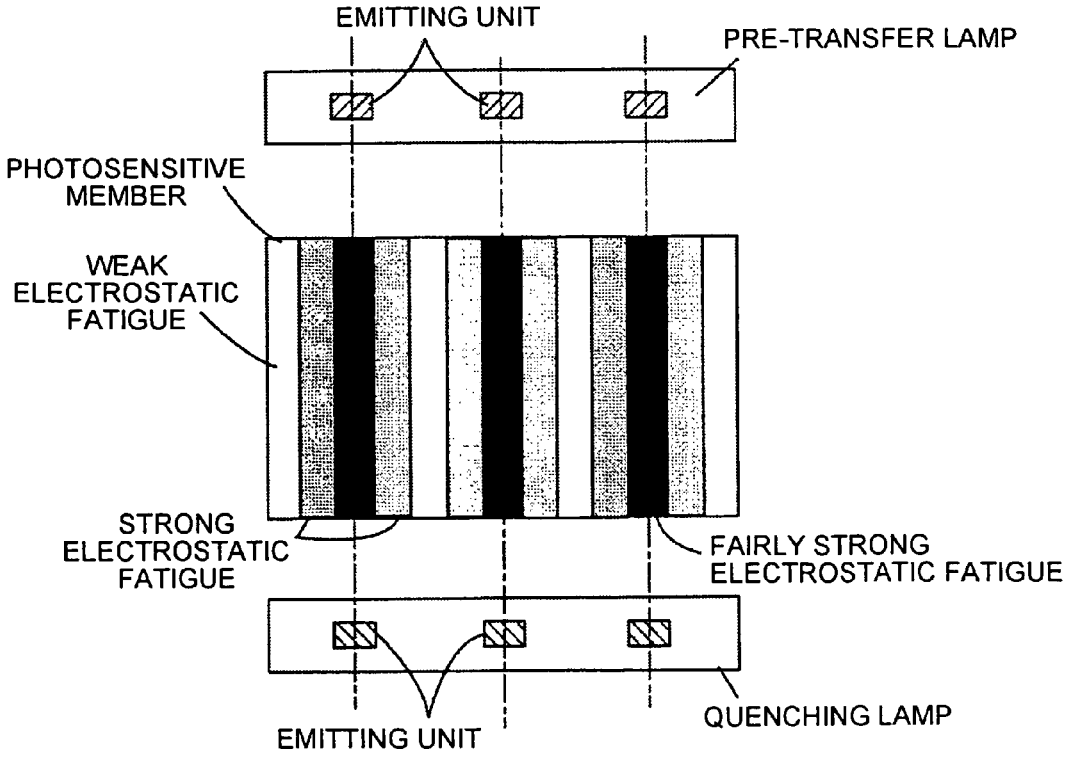
FIG. 6 is a schematic of a conventional structure illustrating a relation between emitting units used in the a pre-transfer lamp and electrostatic fatigue of a photosensitive member.

Pre-transfer exposure is not the only cause of electrostatic fatigue of the photosensitive member. A quenching lamp (QL) that neutralizes the residual charge on the photosensitive member also contributes to the electrostatic fatigue of the photosensitive member. FIG. 6 shows the result obtained when experiment was conducted to determine the degree of electrostatic fatigue resulting from combining the pre-transfer exposure and the quenching process in the present embodiment.

In FIG. 6, the phase of each emitting unit of the LED array forming the pre-transfer lamp 20 is aligned with the phase of one emitting unit of the LED array forming the quenching lamp. The portion of the photosensitive member in line with the emitting unit of the pre-transfer lamp 20 and the emitting unit of the quenching lamp is maximum exposed to emission and hence tends to have the maximum degree of electrostatic fatigue. The degree of electrostatic fatigue diminishes gradually on either side of this portion.

Figure 7:
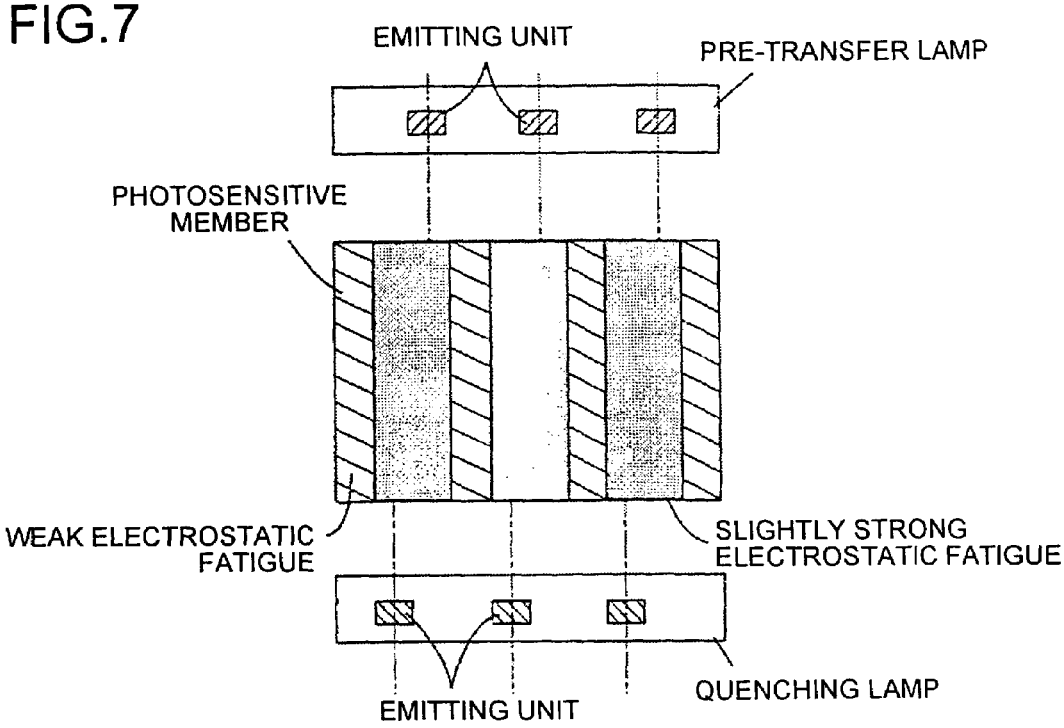
FIG. 7 is a schematic diagram of a structure of the emitting units used in the pre-transfer lamp according to the present embodiment and the electrostatic fatigue of the photosensitive member.
Figure 8:
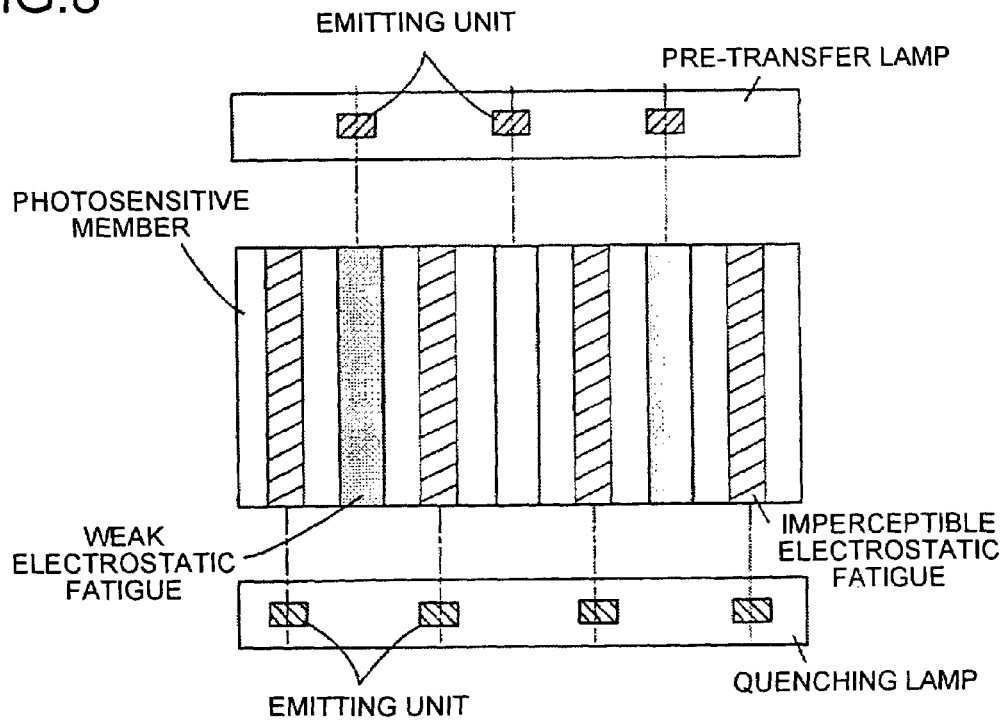
FIG. 8 is a schematic of another structure of the emitting units used in the pre-transfer lamp according to the present embodiment and the electrostatic fatigue of the photosensitive member.

In the present embodiment, the emitting units of the pre-transfer lamp 20 and those of the quenching lamp are positioned in a staggered manner, as shown in FIG. 7 and FIG. 8. Thus, electrostatic fatigue is distributed substantially uniformly throughout the photosensitive member. Particularly, the photosensitive member can be subjected to a uniform exposure by having the same number of emitting units on the LED array of the pre-transfer lamp 20 and the quenching lamp and arranging them in such a way that each emitting unit of one side alternates with the emitting unit of the other side. Consequently, the surface potential on the photosensitive member can be effectively reduced, thereby prolonging the life of the photosensitive member.

Figure 9:
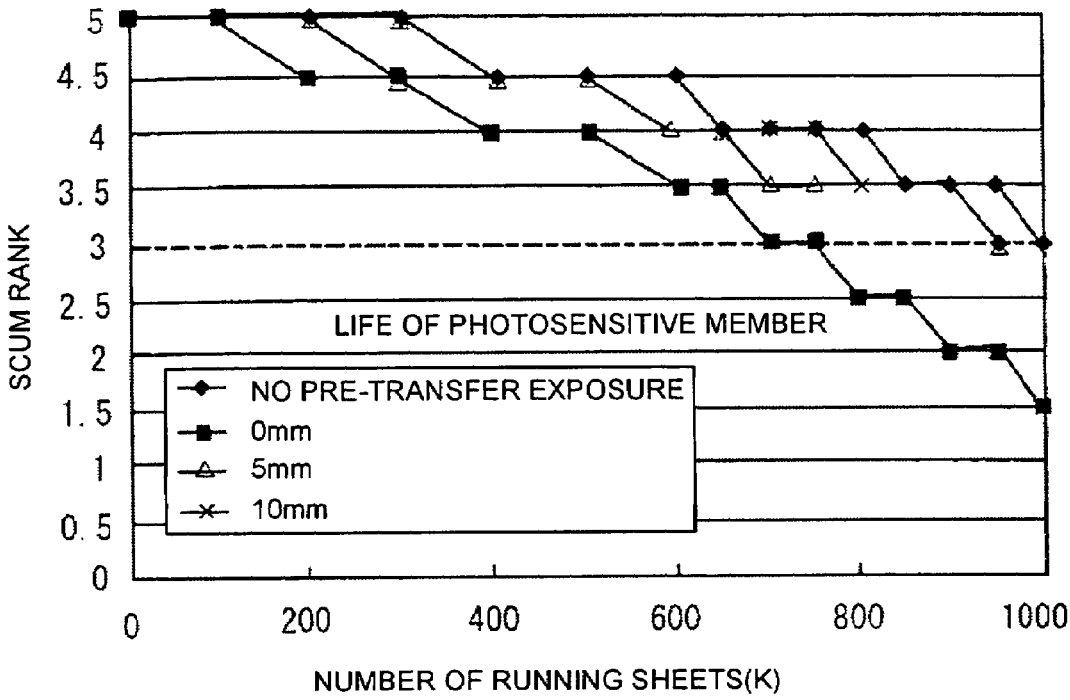
FIG. 9 is a line graph for explaining a result of an experiment for a life of the photosensitive member when the structures shown in FIG. 6 through FIG. 8 are used.

FIG. 9 shows the result obtained by the inventors of the present invention when they conducted experiments to observe scum of the photosensitive member using the structures of the LED arrays shown in FIG. 7 and FIG. 8. The time when the photosensitive member reaches Rank 3 is considered the fatal time for the photosensitive member. The experiments were conducted under four conditions, namely:

(1) no pre-transfer exposure was carried out (2) the emitting units of the pre-transfer lamp 20 and the quenching lamp were aligned (3) the emitting units of the pre-transfer lamp 20 and the quenching lamp were offset by 5 mm (4) the emitting units of the pre-transfer lamp 20 and the quenching lamp were offset by 10 mm.

It can be discerned from the result shown in FIG. 9, the electrostatic fatigue is significant when the phases the emitting units of pre-transfer lamp 20 and the quenching lamp are aligned, and the life of the photosensitive member is shorter as compared with when pre-transfer exposure is carried out.

The life of the photosensitive member is longer under the conditions of both 5 mm and 10 mm phase offset compared with when no pre-transfer exposure is carried out. The life of the photosensitive member was found to be longest under the condition of 10 mm phase offset.

Table 6 shows the result of findings on the life of photosensitive member in relation to the presence or absence of pre-transfer exposure and the position of the emitting units of the pre-transfer lamp 20 and the quenching lamp.

TABLE 6

| Positions of emitting units of PTL and QL | No PTL | Aligned (0 mm) | 5 mm phase offset | 10 mm phase offset (centered) |
|---|---|---|---|---|
| Life of photosensitive member related to electrostatic fatigue | 1000K | 700K | 800K | 950K |

The results shown in Table 6 also corroborates the results shown in FIG. 9.

The structure of the pre-transfer lamp 20 is explained next.

The pre-transfer lamp 20 in the present embodiment is located on the transfer device 6 side inclined at an angle of 57.4° with respect to the straight line joining the axis of the developing roller provided in the developing device 5 shown in FIG. 1 and the axis of the photosensitive drum 2. The pre-transfer lamp 20 may be placed at any position that ensures that the developing device 5 is not subjected to pre-transfer exposure.

Figure 10:
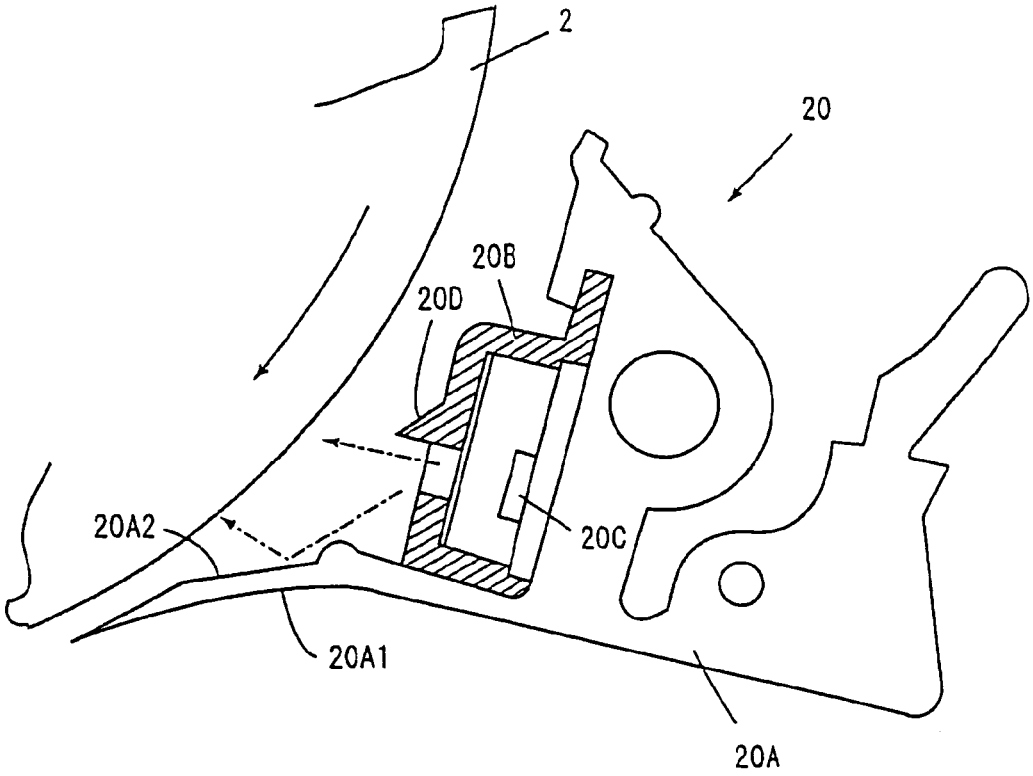
FIG. 10 is a schematic of the pre-transfer lamp in the image forming apparatus shown in FIG. 1.

FIG. 10 is a drawing of the structure of the pre-transfer lamp 20. The pre-transfer lamp 20 includes a transfer sheet inlet guide 20A, which is a molded member composed of a material with high optical reflectance such as aluminum that guides the transfer sheet towards the transfer nip, a covered member 20B set within the transfer sheet inlet guide 20A composed of a heat-resistant material, and a pre-transfer exposure member 20C composed of an LED array and set within the covered member 20B.

The covered member 20B has an opening 20B1 at the point where it faces the photosensitive drum 2. The opening 20B1 allows the light from the pre-transfer exposure member 20C to be directed at the photosensitive drum 2.

The portion of the covered member 20B facing the pre-transfer exposure member 20C, that is, the inside of the opening 20B1, has a dust repellent member 21. The covered member 20B on the side of the developing device 5 of the opening 20B1 is extended into a ridge 20D designed to prevent the light from escaping to the developing device 5.

The dust repellent member 21 is composed of a transparent resin or glass having a photo transmittance of 50% or above and prevents the toner particles or particles of paper from the photosensitive drum 2 from getting into the covered member 20B Thus, by setting the pre-transfer exposure member 20C in the transfer sheet inlet guide 20A, pre-transfer exposure can be accomplished closest to the photosensitive drum 2 under the regulated conditions and with no disruption in the conveyance of the transfer sheet. The molded member used as the transfer sheet inlet guide 20A precisely maintains the position of the pre-transfer lamp 20 with respect to the photosensitive drum 2 and ensures an exposure amount required to set the surface potential of the photosensitive drum 2 to 250 V or less, thereby preventing the transfer sheet from adhering to the surface of the photosensitive drum 2.

If the exposure amount reduces, it leads to the same disadvantage as when the surface potential of the photosensitive drum 2 is set to 250 V or above. In the structure of the pre-transfer lamp 20 described above, apart from the amount of light directly reaching the photosensitive drum from the covered member 20B through the opening 20B1, the light reflected from the transfer sheet inlet guide 20A also contributes to the exposure amount. Therefore, even if the dust repellent member 21 is hypothetically unclean, the light reflected from the transfer sheet inlet guide 20A compensates for the deficit in the amount of light, and therefore lowered surface potential of the photosensitive drum can be ensured.

Table 7 shows the result obtained by the inventors of the present invention when they studied the effect of dust on the dust repellent member 21 on the surface potential of the photosensitive drum 2 when the gap between the photosensitive drum 2 and the pre-transfer lamp 20 was set as 1 mm. '440 K runs' in Table 7 indicates 440,000 image transfers (image output).

TABLE 7

| Transparent film of PTL | 60 sheets | 75 sheets |
|---|---|---|
| NEW | — | −55 to −60 V |
| After 440K runs - pre-cleaning | −95 to −100 V | −100 to −105 V |
| After 440K runs - post-cleaning | −75 to −80 V | −80 to −85 V |

It can be discerned from Table 7 that the maximum surface potential of 105 V is obtained when the dust repellent member 21 is unclean compared with when the dust repellent member 21 is clean. The condition that the surface potential should be less than 250 V is satisfied when the potential is 105 V. It can be discerned from Table 7 that when the surface potential is 105 V, the necessary exposure is guaranteed irrespective of the extent to which the dust repellent member 21 is unclean.

The gap between the photosensitive drum 2 and the pre-transfer lamp 20 remains the same as initially set due to aluminum being used as the molded member forming the transfer sheet inlet guide 20A set in the pre-transfer lamp 20.

The transfer sheet inlet guide 20A in the form of a molded member ensures that the light emitted by the pre-transfer exposure member 20C is reflected uniformly and prevents the variation in the amount of light required to lower the surface potential of the photosensitive drum 2.

The amount of light required for lowering the surface potential of the photosensitive drum 2 can be easily ensured by using a film in which the light transmittance is 50% or greater as the dust repellent member 21. As a result, the leading edge of the transfer sheet can be prevented from adhering to the photosensitive drum 2. As a consequence, the rate of occurrence of pawl separation can be reduced.

However, in the experiments in which films having very high light transmittance were used it was observed that the potential difference between the exposed portion and the non-exposed portion of the photosensitive drum 2 was increased. Consequently, the transfer electrical field between the photosensitive drum 2 and the belt 6C was destabilized, causing the tone from the image portion to scatter. Therefore, it is preferable to use a film having a light transmittance of 50% or above which ensures that no destabilization of transfer electrical field takes place.

Table 8 shows the result of experiment conducted by the inventors of the present invention to study the relation between the light transmittance of the dust repellent member 21, the ability of the transfer sheet to separate, and the tendency of toner scattering. In Table 8, the comment "Good" for the separability indicates an ideal condition where no pawl separation takes place. "POOR" indicates that the undesirable event of pawl separation takes place. "Good" for toner scattering indicates an ideal condition where no toner scattering takes place. "Fair" indicates that a small amount of toner scattering takes place. "POOR" indicates that conspicuous toner scattering on the image takes place.

TABLE 8

| Light transmittance | Separability | Toner scattering |
|---|---|---|
| 100% | Good | Fair |
| 90% | Good | Fair |
| 80% | Good | Good |
| 70% | Good | Good |
| 60% | Good | Good |
| 50% | Good | Good |
| 40% | POOR | Good |
| 30% | POOR | Good |

It can be discerned from Table 8 that if the light transmittance is 50% or greater, particularly, if the light transmittance is between 50% and 80%, the surface potential of the photosensitive drum 2 lowers which causes the transfer sheet to separate from the photosensitive drum 2 more easily, and the toner scattering is prevented. Thus, by using a material with a light transmittance of 50% to 80% in the dust repellent member 21, toner scattering can be prevented and the transfer sheet can be prevented from adhering to the photosensitive drum 2.

In the pre-transfer lamp 20 shown in FIG. 10, the ridge 20D extending towards the photosensitive drum 2 provided in the transfer sheet inlet guide 20A on the side of the developing device 5 prevents the light from escaping towards the developing device 5. Consequently, the charge due to the electrostatically adhering toner on the side of the developing device 5 is maintained.

Figure 11:
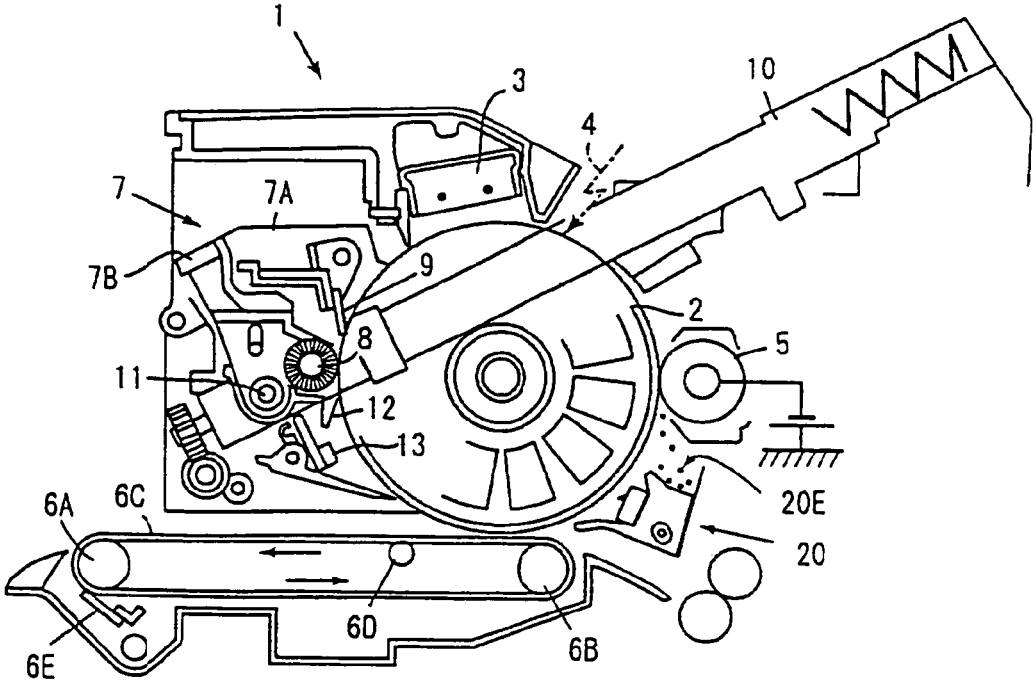
FIG. 11 is a schematic of a structure for preventing scum in a dust repellent member of the pre-transfer lamp.
Figure 12:
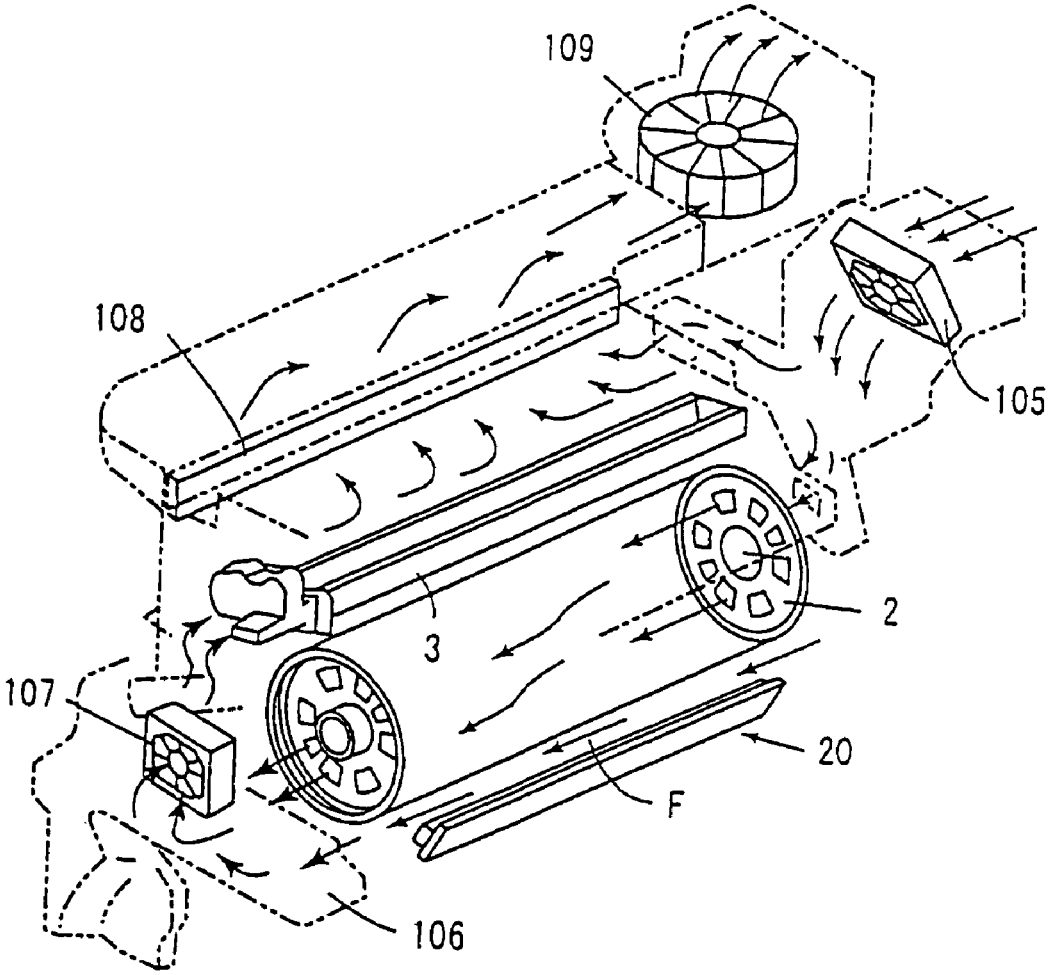
FIG. 12 is a schematic of another structure for preventing scum in the dust repellent member of the pre-transfer lamp.

FIG. 11 and FIG. 12 are schematics of structures for preventing scum of the dust repellent member 21 due to dispersing toner.

In FIG. 11, the face of the enclosure of the pre-transfer lamp 20 facing the developing device 5 has a toner receiving surface 20E which prevents spillage of the toner by catching the toner dispersing from the developing device 5.

Another structure to prevent the toner from scum the dust repellent member 21 involves letting an air current to traverse across the light emitting surface of the pre-transfer lamp 20.

FIG. 12 is the schematic of the structure that allows an air current to traverse across the light emitting surface of the pre-transfer lamp 20. Part of the air current from a cooling fan 105 of the photosensitive drum 2 flows in the space between the photosensitive drum 2 and the pre-transfer lamp 20 juxtaposed against the photosensitive drum 2. The air current from the cooling fan 105 flows in the space between the photosensitive drum 2 and the pre-transfer lamp 20 along the direction of the axis of the photosensitive drum 2.

Part of the air current also enters the photosensitive drum 2. Upon exiting from the other end of the photosensitive drum 2, the air enters an exhaust channel 106 from where it is sucked in by an exhaust fan 107. The air picks up products of neutralization such as ozone when passing by the charging device 3, passes by a filter 108 and is expelled outside by a discharge fan 109.

According to the present invention, the amount of charge on a transfer sheet against a conveying member can be reduced. Particularly, the charge on the leading edge of the transfer sheet that tends to adhere to a latent image carrier can be reduced, thus promoting the transfer sheet and the conveying member to adhere to each other.

Moreover, according to the present invention, surplus charge on the conveying member due to bias impression can be prevented.

Furthermore, according to the present invention, the transfer sheet can be prevented from adhering to the latent image carrier.

Moreover, according to the present invention, a scum due to the separating pawl can be prevented.

Furthermore, according to the present, the transfer sheet can be prevented from adhering to the latent image carrier even under conditions of varying charging properties.

Furthermore, according to the present invention, the leading edge of the transfer sheet can be unequivocally prevented from adhering to the latent image carrier.

Moreover, according to the present invention, the pre-transfer exposing unit is protected from dust and other pollutants.

Furthermore, according to the present invention, light transmission is ensured thereby ensuring the amount of exposure required to reduce the surface potential of the latent image carrier.

Moreover, according to the present invention, the toner dispersing from the developing device can be prevented from settling on and occluding the dust repellent member.

Furthermore, according to the present invention, toner can be prevented from scattering and occluding the dust repellent member.

Moreover, according to the present invention, the toner is prevented from settling on the dust repellent member.

Furthermore, according to the present invention, it is possible to prevent the dust repellent member from getting dirty and to maintain performance of the pre-transfer exposure without having an additional unit.

Moreover, according to the present invention, electrostatic fatigue of the latent image carrier is prevented and the life of the latent image carrier can be enhanced, and uneven exposure can be prevented.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus that includes a structure in which an electrostatic latent image formed on a latent image carrier is developed into a visible image, and the visible image is transferred onto a transfer material being carried by a conveying member, the image forming apparatus comprising:

a pre-transfer exposing unit that makes only a portion of the latent image carrier that corresponds to a leading edge of the transfer material expose before the visible image is transferred to the transfer material; and a transfer-bias applying unit configured to apply to the latent image carrier biases of different bias values for transferring the visible image onto the transfer material, wherein the transfer-bias applying unit starts applying the bias to the transfer material when a predetermined time is passed from a point of time at which the leading edge of the transfer material comes into a contact with the latent image carrier by controlling the pre-transfer exposing unit and a bias applying timing of the transfer-bias applying unit.

2. The image forming apparatus according to claim 1, wherein the transfer bias applying unit starts applying the bias when the transfer material is transferred for a predetermined distance from a position from which the transfer material is sent out toward the latent image carrier.

3. The image forming apparatus according to claim 1, wherein the transfer bias applying unit starts applying the bias delaying for a time equivalent to a time in which the transfer material is transferred for a predetermined distance from a point of time at which the transfer material passes the position from which the transfer material is sent out toward the latent image carrier to the point of time at which the leading edge of the transfer material comes into a contact with the latent image carrier.

4. The image forming apparatus according to claim 1, wherein the transfer bias applying unit applies to the leading edge a bias having a lower value than a standard value, and then, applies the bias having the standard value.

5. The image forming apparatus according to claim 1, wherein the transfer bias applying unit applies a bias having a lower value than a standard value to the leading edge on which no image is formed, and starts applying a bias having the standard value when an edge of a portion on which an image is formed on the transfer material faces the latent image carrier.

6. The image forming apparatus according to claim 1, wherein a charge density at the leading edge on which no image is formed is set to $2.0\times10^{-8}$ C/cm$^2$ or lower that is lower than a charge density when a bias having a standard value is applied.

7. The image forming apparatus according to claim 1, wherein the pre-transfer exposing unit sets, for the latent image carrier, a surface potential that prevents the leading edge from adhering to the latent image carrier based on delay time in a bias applying timing of the transfer bias applying unit.

8. The image forming apparatus according to claim 1, wherein the pre-transfer exposing unit sets, for the latent image carrier, a surface potential of a portion corresponding to a portion of the transfer material on which no image is formed to a potential that prevents the portion of the transfer material from adhering to the latent image carrier, the portion between the leading edge and a portion on which an image is formed, based on delay time in a bias applying timing of the transfer bias applying unit.

9. The image forming apparatus according to claim 7, wherein the pre-transfer exposing unit sets a surface potential of a region that corresponds to the leading edge, on which no image is formed, to 250 volts or lower.

10. The image forming apparatus according to claim 8, wherein the pre-transfer exposing unit sets a surface potential of a region that corresponds to the leading edge, on which no image is formed, to 250 volts or lower.

11. The image forming apparatus according to claim 1, where an operation timing of at least one of the pre-transfer exposing unit and the transfer-bias applying unit is controlled depending on at least one of a type of the transfer material and an image forming mode.

12. The image forming apparatus according to claim 1, wherein an operation timing of at least one of the pre-transfer exposing unit and the transfer-bias applying unit is possible to be controlled according to an environmental condition such as temperature and humidity.

13. The image forming apparatus according to claim 11, further comprising:

a control unit that controls switching on and off of the pre-transfer exposing unit and the transfer bias applying unit, and that includes an input end and an output end;

a determining unit that determines a type of the transfer material, and that is connected to the input end; and a detecting unit that detects an environmental condition, and that is connected to the output end, wherein the pre-transfer exposing unit and the transfer bias applying unit are connected to the input end, and the operation timing is controlled based on a signal from any one of the determining unit and the detecting unit.

14. The image forming apparatus according to claim 12, further comprising:

a control unit that controls switching on and off of the pre-transfer exposing unit and the transfer bias applying unit, and that includes an input end and an output end;

a determining unit that determines a type of the transfer material, and that is connected to the input end; and a detecting unit that detects an environmental condition, and that is connected to the input end, wherein the pre-transfer exposing unit and the transfer bias applying unit are connected to the output end, and the operation timing is controlled based on a signal from any one of the determining unit and the detecting unit.

15. The image forming apparatus according to claim 13, wherein an image forming mode is input to the control unit, and the image forming mode includes a single-side mode in which an image is formed on a single side of the transfer material, a double-side mode in which an image is formed on both sides of the transfer material, and color mode in which an image having various colors is formed on a single side of the transfer material.

16. The image forming apparatus according to claim 14, wherein an image forming mode is input to the control unit, and the image forming mode includes a single-side mode in which an image is formed on a single side of the transfer material, a double-side mode in which an image is formed on both sides of the transfer material, and color mode in which an image having various colors is formed on a single side of the transfer material.

17. The image forming apparatus according to claim 1, further comprising:

a transfer nip that is formed at a position at which the transfer material contacts with the latent image carrier; and a guiding member that guides the transfer material toward the transfer nip, wherein the pre-transfer exposing unit is integrated with the guiding member.

18. The image forming apparatus according to claim 17, wherein a guiding surface of the guiding member is highly reflective.

19. The image forming apparatus according to claim 17, wherein the guiding member is molded.

20. The image forming apparatus according to claim 17, wherein the guiding member includes a dust repellent member, and the dust repellent member is arranged at a position at which the pre-transfer exposing unit is arranged on a side from which the pre-transfer exposing unit emits light.

21. The image forming apparatus according to claim 20, wherein the dust repellent member is formed with a transparent film.

22. The image forming apparatus according to claim 20, wherein the dust repellent member is formed with any one of a transparent resin and glass.

23. The image forming apparatus according to claim 17, the guiding member includes a collecting unit for a scattered toner from a developing device that is arranged near the guiding member, and the collecting unit is a toner receiving surface that is arranged on a side that faces to the developing device.

24. The image forming apparatus according to claim 17, wherein the guiding member includes a light emitting unit, and a toner receiving member that is formed with a eaves arranged on a side on which a developing device that is arranged.

25. The image forming apparatus according to claim 17, wherein the pre-transfer exposing unit includes a light emitting unit, and an air current that traverses the light emitting unit is generated in a space between the pre-transfer exposing unit and the latent image carrier.

26. The image forming apparatus according to claim 25, further comprising a fan for cooling the latent image carrier, wherein the air current is generated by the fan.

27. The image forming apparatus according to claim 1, further comprising a static removing unit to remove static electricity on the latent image carrier, wherein the latent image carrier and the pre-transfer exposing unit are arranged in such a manner that a phase of a position at which light is emitted on a surface of the latent image carrier is different between a light emitted by a light emitting unit of the pre-transfer exposing unit and a light emitted by a light emitting unit of the static removing unit.

28. The image forming apparatus according to claim 27, wherein number of the emitting units arranged in the pre-transfer exposing unit and number of the emitting units arranged in the static removing unit are identical.

* * * * *